US011235363B2

(12) United States Patent
Bucci et al.

(10) Patent No.: US 11,235,363 B2
(45) Date of Patent: Feb. 1, 2022

(54) ROLLING MILL STAND WITH ROLLS AXIALLY CONSTRAINED WITH ELASTIC SYSTEM

(71) Applicant: Danieli & C. Officine Meccaniche S.P.A., Buttrio (IT)

(72) Inventors: Annibale Bucci, Dalmine (IT); Cesare Laviosa, Cogoleto (IT); Giorgio Solaroli di Briona, Milan (IT); Angelo D'Alessandro, Paderno Dugnano (IT); Ettore Cernuschi, Castelletto Sopra Ticino (IT)

(73) Assignee: DANIELI & C. OFFICINE MECCANICHE S.p.A., Buttrio (IT)

( * ) Notice: Subject to any disclaimer, the term of this patent is extended or adjusted under 35 U.S.C. 154(b) by 154 days.

(21) Appl. No.: 16/479,544

(22) PCT Filed: Jan. 26, 2018

(86) PCT No.: PCT/IB2018/050484
§ 371 (c)(1),
(2) Date: Jul. 19, 2019

(87) PCT Pub. No.: WO2018/138679
PCT Pub. Date: Aug. 2, 2018

(65) Prior Publication Data

US 2019/0381545 A1 Dec. 19, 2019

(30) Foreign Application Priority Data

Jan. 27, 2017 (IT) ..... 102017000008975

(51) Int. Cl.
*B21B 13/10* (2006.01)
*B21B 17/14* (2006.01)

(52) U.S. Cl.
CPC ..... *B21B 13/103* (2013.01); *B21B 13/10* (2013.01); *B21B 17/14* (2013.01)

(58) Field of Classification Search
CPC ..... B21B 17/02; B21B 17/04; B21B 17/14; B21B 13/10
See application file for complete search history.

(56) References Cited

U.S. PATENT DOCUMENTS 4,021,900 A * 5/1977 Gibson ..... B21B 27/035 492/1
4,976,129 A * 12/1990 Setzer ..... B21B 31/18 72/247
2013/0255343 A1* 10/2013 Cernuschi ..... B21B 35/00 72/249

FOREIGN PATENT DOCUMENTS

CN 2887474 Y 4/2007
DE 3103156 A1 8/1982
(Continued)

OTHER PUBLICATIONS

Heimann, Translation of WO03068448 (Year: 2003).*

*Primary Examiner* — Gregory D Swiatocha
*Assistant Examiner* — Bobby Yeonjin Kim
(74) *Attorney, Agent, or Firm* — Stetina Brunda Garred and Brucker

(57) ABSTRACT

A rolling mill stand for rolling rod-shaped bodies, in particular tubular bodies, said stand comprising at least three rolls (10) mutually arranged to define a rolling pass line for said rod-shaped and/or tubular bodies, wherein at least one of said three rolls (10) is rigidly mounted on a roll holder shaft (20), freely fixed in turn in a rotational manner to said stand by means of a first hollow support (40) and a second hollow support (30) arranged on opposite sides of said at least one roll (10), respectively, wherein a first portion (21) and a second portion (22) of said roll holder shaft (20) are
(Continued)

housed in said first hollow support (40) and in said second hollow support (30), respectively, where the constraint between at least said first hollow support and said first portion (21) of the roll holder shaft is of elastic type.

12 Claims, 10 Drawing Sheets

(56) References Cited

FOREIGN PATENT DOCUMENTS

| | | | | | |
|---|---|---|---|---|---|
| DE | 102004054861 | A1 | | 5/2006 | |
| EP | 2772320 | A1 | | 9/2014 | |
| WO | WO03068448 | | * | 8/2003 | ..... B21B 27/02 |
| WO | WO2009141414 | A1 | | 11/2009 | |

* cited by examiner

100

100

ROLLING MILL STAND WITH ROLLS AXIALLY CONSTRAINED WITH ELASTIC SYSTEM

CROSS REFERENCE TO RELATED APPLICATION(S)

The present application claims priority to PCT International Application No. PCT/IB2018/050484 filed on Jan. 26, 2018, which application claims priority to Italian Patent Application Nos. 102017000008973 filed Jan. 27, 2017, the entirety of the disclosures of which are expressly incorporated herein by reference.

STATEMENT RE: FEDERALLY SPONSORED RESEARCH/DEVELOPMENT

Not Applicable.

TECHNICAL FIELD OF THE INVENTION

The present invention falls within the field of rolling rod-shaped elements. In particular, the present invention falls within the field of rolling tubes, in particular seamless tubes. In detail, the present invention relates to a rolling mill stand for rolling rod-shaped elements, in particular seamless tubes. In greater detail again, the present invention relates to a rolling mill stand of the aforesaid type, equipped with a plurality of rolls constrained axially in an elastic manner.

BACKGROUND ART

The rolling of rod-shaped elements, in particular of tubular elements, by means of rolling mill is known from the prior art, the rolling mill comprising a plurality of rolling mill stands arranged in sequence along a predetermined direction, wherein each rolling mill stand comprises a plurality of rolls, for example idler but also motorized rolls and variable in number (e.g. three), according to the needs and/or circumstances, mutually arranged so as to define a forced pass line for the rod-shaped elements and/or tubes to be rolled; the rolling of each tube therefore occurs by means of forced insertion of the tube into pass lines of the successive stands by means of a spindle inserted in the tube itself.

In particular, each roll is shaped so that the mutual arrangement of the rolls in each stand allows the definition of a substantially circular pass line.

Moreover, the need is known among the operators in this field to periodically reshape the outer surface of the rolls to compensate for the wear of the rolls themselves and/or for the deformations thereof due to the increased forces involved during the rolling; for this purpose, the rolls are periodically subjected to regeneration, according to different processes based on the type of rolls, in particular for example via the removal of material by turning. Indeed, both rolls constrained axially in a rigid manner to the respective stand (where therefore the constraint of the roll to the stand is such as to exclude any translation in a direction parallel to the longitudinal symmetry axis of the roll) and rolls constrained to the respective stand so as to translate parallel to the longitudinal axis of the roll, possibly within a given distance defined as clearance, are known. The rolls of both types have drawbacks that the present invention aims at overcoming or at least minimizing.

Indeed, the rolls of the first type—axially constrained to the stand in a rigid manner—allow to be turned directly on the stand, and therefore without the need to be removed from the stand itself, except that the rigid axial constraint does not allow possible knocks or thrust excesses due to the process peculiarities and/or occasional misalignments to be adequately compensated for, where the rolls or other components of the stand are thus subjected to the increased risk of breaking and/or damage. An example of such rolls is shown and described in Patent Application DE 10 2004 054861.

On the other hand, the rolls of the second type—axially movable—have the advantage of compensating for possible misalignments and therefore of reducing the risk of breaks, failures and/or damage, but they are to be removed from the stand to be subjected to turning; indeed, when engaged by the lathe tool, the axially movable rolls are subjected to inevitable movements where the desired shape may not be given to the roll. Moreover, the roll removal and remounting operations are lengthy and complicated and therefore costly operations, also in consideration of the machine downtimes to which the whole rolling mill is to be subjected or to the number of replacement stands which are to be available to ensure the production continuity.

Moreover, precisely for the fact that they are individually reshaped, the rolls of the second type are subjected to increased movements during the rolling because the union of the respective profiles thereof will deviate more from the shape defined to equally divide the loads due to the deformation of the material being rolled. The increased frequency and entity of such movements may also be the cause of leakages of process liquids (for example, cooling water of the rolls) into the stand or its parts, with subsequent damage of the components thereof.

Therefore, it is the main object of the present invention to overcome or at least minimize the problems summarized above and detected in the rolls according to the prior art of both types, i.e. both in those with rigid axial constraint and in those axially movable.

In particular, it is a first object of the present invention to provide a solution for the constraint of the rolls to the stand which allows both a movement (realignment of the rolls), for example when they are engaged by the incoming tube, and the turning of the rolls directly on the stand and therefore without a need to remove the roll from the stand beforehand.

It is a further object of the present invention to provide a solution which allows to reduce the knocks and thrusts causing damage to the inner components of the stand.

It is also an object of the present invention to provide a solution of the aforesaid type which can be achieved and/or installed at low costs and by means of operations with reduced and/or equally contained complexity.

Finally, it is a further object of the present invention to provide a solution of the aforesaid type which is applicable to different rolling mill stands, in particular for rolling both generally rod-shaped elements and tubes, in particular seamless tubes.

DESCRIPTION OF THE PRESENT INVENTION

The present invention is based on the general consideration that the drawbacks encountered in rolls according to the prior art and briefly summarized above may be overcome by means of an elastic type constraint solution, where the roll is kept in position in the stand by means of elastic forces of predefined intensity and in particular, greater than the axial thrusts generated by a lathe tool but less than the axial forces generated for example, by a tube entering the stand in case of misalignment of the rolls of successive stands and/or of incorrect positioning and/or non-uniformity of conformation of the rolls of the same stand.

Thereby, indeed the axial movements of the roll are prevented during the turning (which therefore may be performed without there being a need to remove the rolls from the stand), moreover allowing axial movements in case of axial forces which possibly intervene during the rolling (and due for example, to the above misalignments and/or non-uniformities) with much greater intensities than those generated by a lathe tool.

In consideration of both the above and the drawbacks encountered in the rolling mill stands and/or in the rolling rolls according to the prior art, the present invention in one embodiment thereof relates to a rolling mill stand for rolling rod-shaped bodies, in particular tubular bodies, said stand comprising at least three rolls mutually arranged to define a rolling pass line for said rod-shaped and/or tubular bodies, wherein at least one of said three rolls is rigidly mounted on a roll holder shaft, freely fixed in turn in a rotational manner to said stand by means of a first hollow support and a second hollow support arranged on opposite sides of said at least one roll, respectively, where a first portion and a second portion of said roll holder shaft are housed in said first hollow support and in said second hollow support, respectively; where said stand comprises elastic means interposed between said first portion of roll holder shaft and said first hollow support to define an elastic type axial constraint between said roll holder shaft and said first support, and where the translation of said roll holder shaft along a translation direction parallel to its symmetry axis transforms into the compression or extension of at least part of said elastic means and is thus contrasted by the resistance exerted by at least said part of said elastic means.

According to one embodiment, the translation of said roll holder shaft along a translation direction parallel to its symmetry axis also results in the expansion of at least part of said elastic means.

According to one embodiment, said elastic means are of conical type and are mounted on said first portion of said roll holder shaft.

According to one embodiment, said stand comprises first supporting means rigidly keyed onto said first portion of said roll holder shaft and adapted to facilitate the rotation of said first roll holder shaft with respect to said first support, where said elastic means comprise first elastic means and second elastic means arranged along said first portion of said roll holder shaft on opposite sides of said first supporting means, respectively.

According to one embodiment, said stand comprises first supporting means rigidly keyed onto said first portion of said roll holder shaft and adapted to facilitate the rotation of said first roll holder shaft with respect to said first support, where said elastic means are arranged along said first portion of said roll holder shaft in an inner space defined by said first supporting means.

According to one embodiment, said first supporting means define a first engagement shoulder and a second engagement shoulder, where said first hollow support defines a third engagement shoulder and a fourth engagement shoulder, and where said first elastic means engage said first engagement shoulder and said third engagement shoulder, while said second elastic means engage said second engagement shoulder and said fourth engagement shoulder.

According to one embodiment, said first supporting means define a first engagement shoulder and a second engagement shoulder, where said elastic means engage said first engagement shoulder and said second engagement shoulder.

According to one embodiment, said first supporting means comprise a first ball bearing and a second ball bearing.

According to one embodiment, said stand further comprises switching locking means which can be alternatively activated and deactivated, where the activation of said locking means results in the switching of the axial constraint between said roll holder shaft and said first support from elastic to rigid.

According to one embodiment, said stand further comprises means for adjusting the preload of said first and second elastic means.

According to one embodiment, said stand further comprises means for adjusting the position of the roll in the direction of the longitudinal symmetry axis thereof.

The present invention also relates to a rolling mill, in particular for rolling tubes, in particular seamless tubes, said rolling mill comprising at least two rolling mill stands arranged in sequence along a predetermined direction, said rolling mill comprising at least one rolling stand according to one of the embodiments of the present invention.

Possible further embodiments of the present invention are defined in the claims.

BRIEF DESCRIPTION OF THE DRAWINGS

The present invention will be further clarified below by means of the following detailed description of the possible embodiments depicted in the drawings where features and/or corresponding or equivalent component parts of the present invention are identified by the same reference numerals. It is worth noting that the present invention in any case is not limited to the embodiments described below and depicted in the drawings; contrarily, all those variants and/or modifications of the embodiments described below and depicted in the accompanying drawings, which are clear and apparent to those skilled in the art, fall within the scope of the present invention.

In the drawings.

DETAILED DESCRIPTION OF THE PRESENT INVENTION

The present invention is particularly applicable in the field of rolling rod-shaped elements, in particular tubes, this being the reason for which the present invention is described below with particular reference to the applications thereof in the field of rolling tubular elements.

It is in any case worth noting that the possible applications of the present invention are not limited to those described below. Contrarily, the present invention is conveniently applied in all the cases of rolling rod-shaped elements in general.

Figure 1:
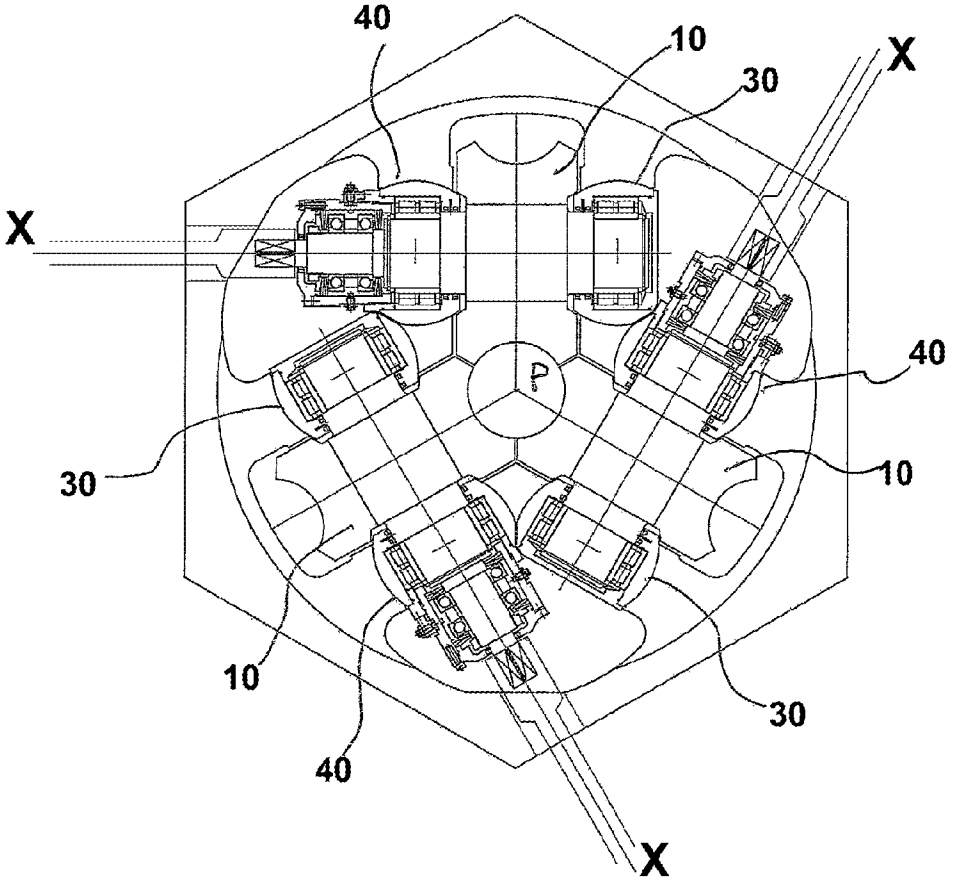
FIG. 1 shows a first cross-section view of a stand according to one embodiment of the present invention.

Numeral 100 in FIG. 1 identifies a rolling mill stand equipped with three rolls 10 according to a first embodiment of the present invention; the rolls 10 are constrained in a rotational manner to stand 100 (to the frame thereof) and are arranged mutually so as to define a rolling pass line P. Stands of the type depicted in FIG. 1 therefore are used in rolling mills and, for the purpose, are arranged in sequence along a rolling mill with as accurate as possible alignment of the respective pass lines P, the pass lines P further having size and inner shape different from one stand to the next according to the rolling needs.

The rolls 10 are each mounted on a corresponding shaft 20 according to substantially identical methods, where a description of the mounting methods of a roll 10 on the respective rotation shaft 20 will be given below. It is in any case worth noting that according to the present invention and according to the needs and/or circumstances, the fixing and/or mounting methods of the rolls 10 on the respective shafts 20 in each individual stand 100 may also vary from one roll to the next.

Figure 2:
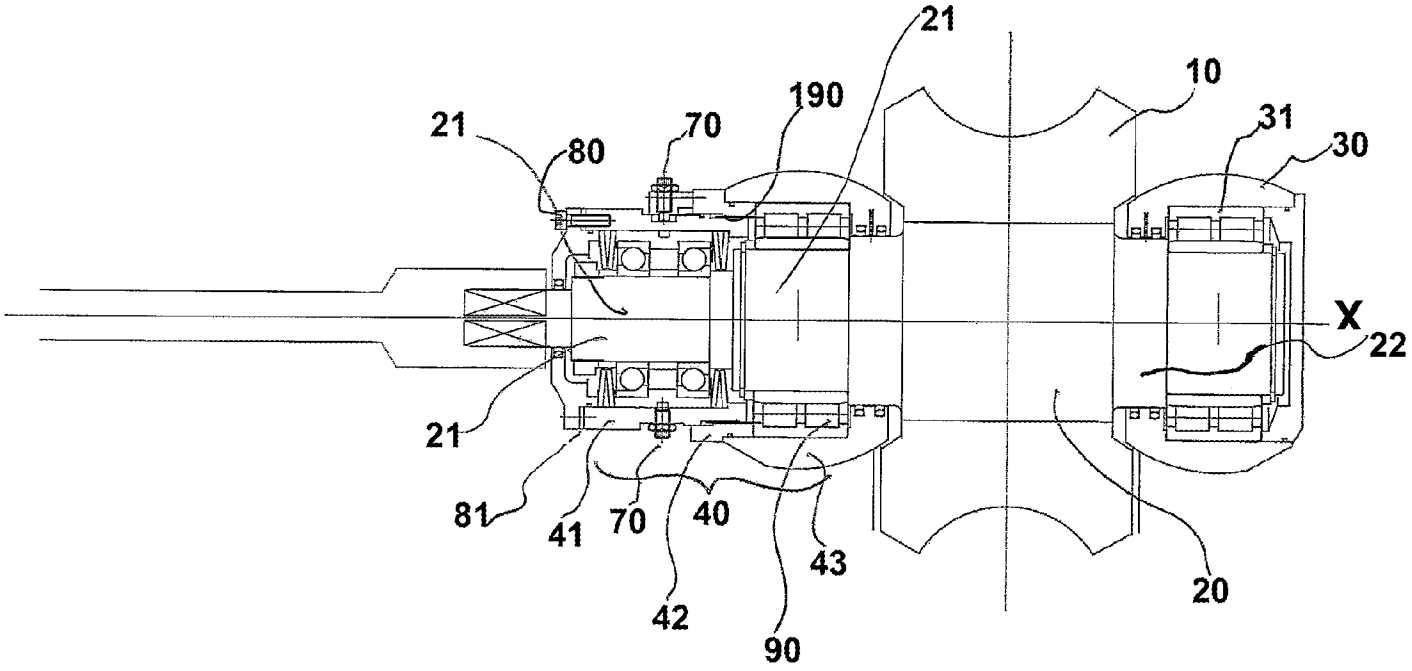
FIG. 2 shows a second longitudinal sectional view of a roll assembly and related supporting systems according to one embodiment of the present invention.
Figure 5:
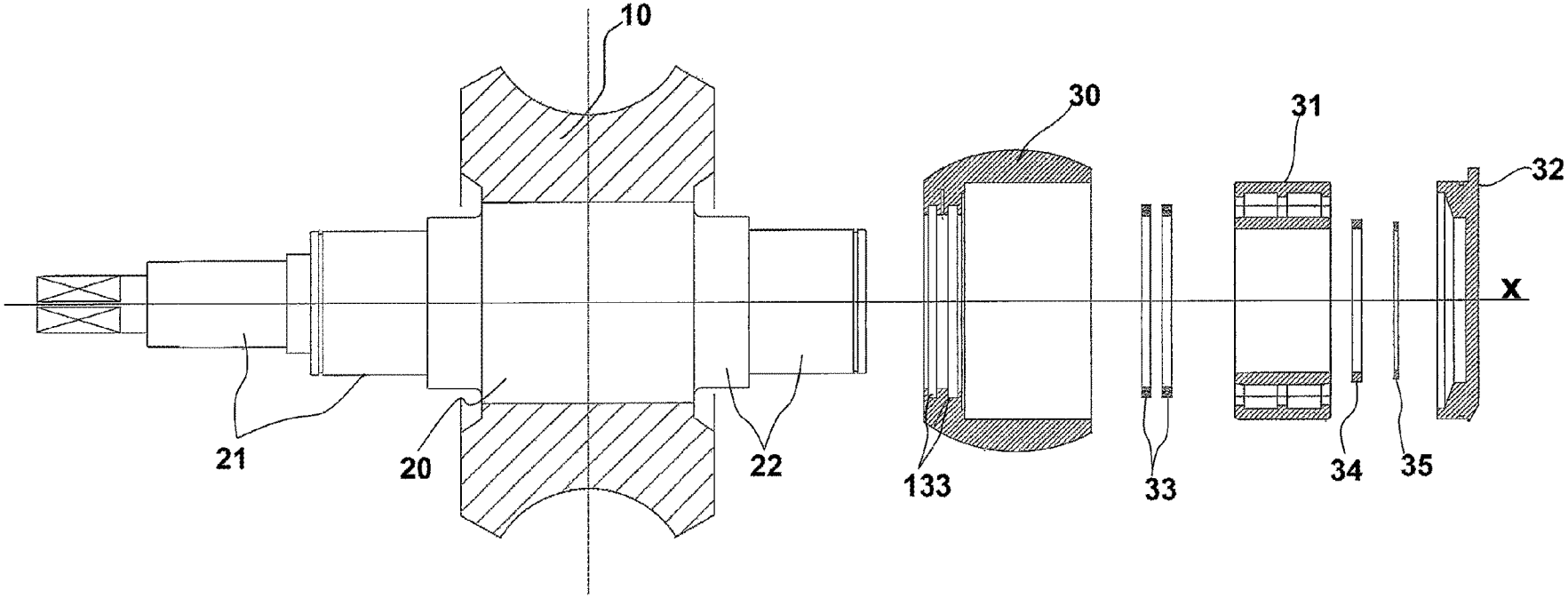

As depicted in FIG. 2, roll 10 is keyed onto a substantially intermediate portion of the rotation shaft 20 so as to be rigidly fixed thereto, where therefore when put into rotation, roll 10 drags shaft 20 in rotation, or vice versa according to the type of rolling mill or stand. The rotational constraint between shaft 20 and stand 100 therefore is obtained by means of a first hollow support 40 and a second hollow support 30, said hollow supports 40 and 30 being rigidly fixed to the rolling mill stand 100. In the case of the second hollow support 30, the rotation of shaft 20 with respect to the support 30 itself is obtained by interposing second supporting means 31 between support 30 and an end portion 22 of the roll holder shaft 20, the second supporting means being formed for example, by a roller bearing including an outer ring in contact with the second hollow support 30 and an inner ring in contact with the end portion 22 of the roll holder shaft 20, and also by two series of rolls interposed between the outer ring and the inner ring. In particular, the inner ring is rigidly fixed on the roll holder shaft 20 (on the end portion 22), while the outer ring is rigidly fixed to the second hollow support 30. Moreover, as depicted in particular in FIGS. 3 and 5, two gaskets 33 housed in corresponding seats 133 are interposed between the second hollow support 30 and the roller bearing 31, respectively, the gaskets 33 essentially having the purpose of preventing process liquid infiltrations into the second hollow support 30 which could compromise the functionality of bearing 31. Finally, according to methods which essentially are known and therefore are not described in detail below, bearing 31 is kept in position on the roll holder shaft 20 by means of a first ring 34 and a second elastic ring 35, and finally also by means of a cover 32 fixed (for example screwed) to the end portion of the second hollow support opposite to roll 10.

In the case of the first hollow support 40, the latter instead is formed by three hollow elements fixed mutually so as to house a first portion 21 of the roll holder shaft 21; in particular, said first hollow support 40 comprises a first hollow element 43 substantially similar to the second hollow support 30, a ring nut 42 fixed to said first hollow support 43, and finally a cartridge 41, which is also hollow and fixed to the ring nut 42 according to methods described in detail below. First supporting means adapted to allow the rotation of the roll holder shaft 20 with respect to the first hollow support 40 are interposed between the first hollow support 40 and the corresponding first portion 21 of the roll holder shaft 20; said means in particular comprise a first roller bearing 90 interposed between the portion 21 of shaft 20 and the first hollow support 43, where also in this case there are provided sealing means consisting of a pair of gaskets 44 housed in corresponding seats 45 of the hollow element 43, respectively, and having also in this case the purpose of preventing water infiltrations into the hollow element 43 (more generally into the hollow support 40) which could compromise the functionality of the roller bearing 90 or of the bearings 62 and 63. Also the roller bearing 90 comprises an inner ring rigidly fixed to shaft 20 (to the portion 21 of shaft 20), an outer ring rigidly fixed to the hollow element 43 and two series of rolls interposed (housed) between the inner ring and the outer ring. The ring nut 42 is fixed to the end portion of the hollow element 43 opposite to roll 10, where there are also provided locking means 142 which are substantially similar to the locking means 34 and 35 in order to lock bearing 90 in position, said locking means 142 therefore comprising again a first ring and a second elastic ring. The outer surface of cartridge 41 further comprises a threaded portion 190, where the mutual engagement of said threaded portion 190, by screwing on a corresponding threaded portion 198 of the ring nut 42, ensures both the mutual fixing of cartridge 41 and of the ring nut 42, and the adjustment of the mutual positioning of cartridge 41 with respect to the ring nut 42, and therefore the degree of penetration of cartridge 41 in the ring nut 42. First elastic means 51, a first ball bearing 63, a containment and/or housing element 65, a second ball bearing 62, second elastic means 52 and a first ring 66 and a second ring 67 are interposed between cartridge 41 and portion 21 of the roll holder shaft 20, in particular mounted (e.g. keyed) on the portion 21 of shaft 20, in sequence from right to left with respect to the drawings and therefore away from roll 10. Element 65 in particular comprises an inner ring and an outer ring and is rigidly fixed to shaft 20 (to portion 21), the first ball bearing 63 and the second ball bearing 62 being housed between the outer ring and the inner ring of element 65. Finally, there are provided an assembly of spacers 81 and a cover 69 adapted to be fixed to cartridge 41 according to methods described in detail below.

Figure 4:
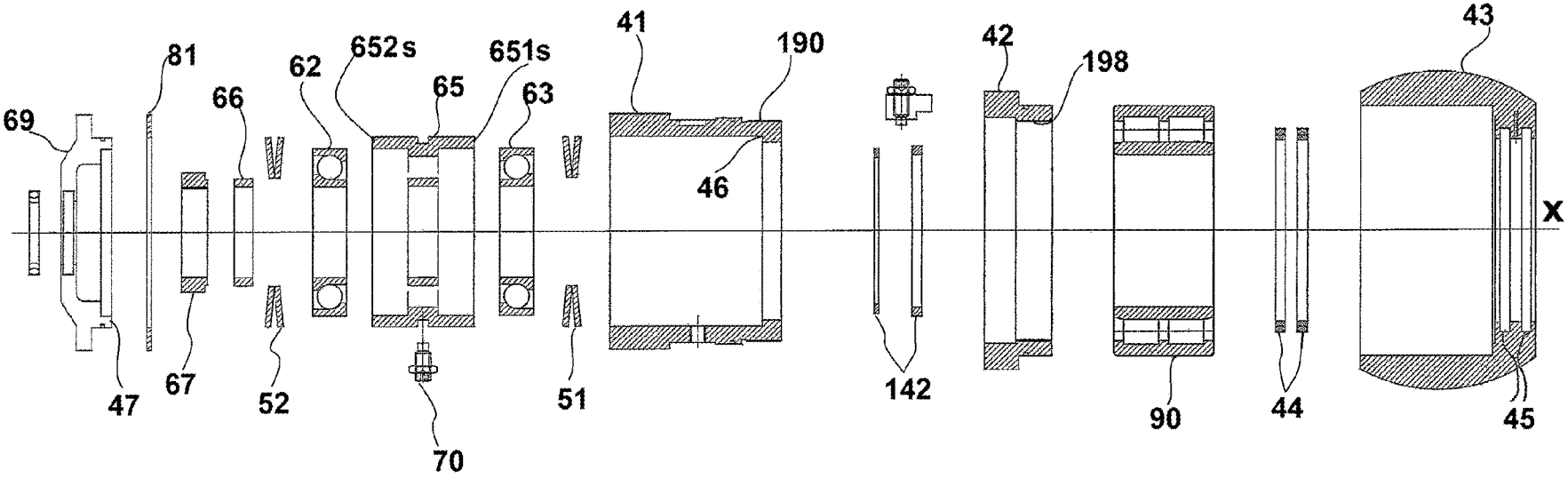
FIGS. 4 and 5 show further longitudinal and exploded sectional views of a roll assembly and related supporting systems and/or parts thereof according to embodiments of the present invention.

With reference to FIG. 4, it is also worth noting that cartridge 41 is shaped so as to define an inner contrast and/or engagement shoulder 46, therefore where the first elastic means 51 engage said shoulder 46 and an opposite shoulder **65*s*1 defined by the outer ring of element 65. In a substantially similar manner, the second elastic means 52 engage a shoulder 65*s*2 defined by the outer ring of element 65 and a shoulder 47 defined by cover 69**. Although it is apparent in consideration of that indicated above, for completeness of disclosure it is worth noting how the engagement and/or contrast shoulders described above are all shaped like a circular crown according to a view along the longitudinal symmetry axis X.

It is also worth noting from that disclosed above that the positioning of the roll in axial direction (along axis X) with respect to the second hollow support 30 and to the hollow element 43 may be adjusted and selected by adjusting the screwing of cartridge 41 on the ring nut 42; indeed, assuming to increase the screwing of cartridge 41 on the ring nut 42, and therefore to increase the penetration (to the right with respect to the drawings) of cartridge 41 in the ring nut 42, by penetrating the ring nut 42, cartridge 41 drags cover 69 therewith in its translation, and therefore also all the components housed in cartridge 41, i.e. the elastic means 51 and 52, the ball bearings 63 and 62 and element 65, due to the thrust exerted on bearing 62 by the elements 66 and 67. Therefore also the shaft is dragged in the same direction (to the right with respect to the drawings), since assembly 60 of the bearings 63 and 62 and of element 65 is rigidly fixed to shaft 20.

A further peculiarity of the roll according to the embodiment described above and depicted in drawings 1 to 5 relates to adjustment means 80, 81 for adjusting the preload of the elastic elements 51; said adjustment means in particular comprise a plurality of screws 80 each housed in a corresponding through hole of cover 69, wherein each screw 80 engages a threaded blind hole made in cartridge 41. Some spacers 81 (variable in number according to the needs and/or circumstances) are also interposed between cover 69 and cartridge 41; it is therefore shown how the degree of compression (preload) of the elastic means 51 and 52 increases as the thickness of the adjusting spacers 81 decreases because the degree of compression of the elastic means 52 between cover 69 and surface 65*s*2, and also of the elastic means 51 between cartridge 41 and surface 65*s*1, increases as the thickness of said spacers 81 decreases, while contrarily, increasing the thickness of the spacers 81 decreases the preload of the elastic means 51 and 52.

Finally, there are provided locking means 70 consisting of a plurality of grub-screws 70 which each cross an internally threaded through hole of cartridge 41 and engage the outer surface of the outer ring of element 65, thereby rigidly fixing the roll holder shaft 20 to cartridge 41 and therefore to the first hollow support 40 and finally to stand 100. It is therefore apparent from that disclosed above that once the position of shaft 20 is defined by selecting the engagement by screwing between cartridge 41 and the ring nut 42, axial movements of shaft 20 (along a direction parallel to the longitudinal symmetry axis X) are possible only in case of forces acting on shaft 20, whose axial and parallel component to the longitudinal symmetry axis X is such as to overcome the resistance of the elastic means 51 and 52. Such elastic means 51 and 52 may be designed and made so as to achieve a differentiated behavior (rigidity) between the preload steps and the working steps, and therefore ensure compliance with the operating needs both in the regeneration step (e.g. turning) of the rolls and during rolling.

The behavior of roll 10, in particular of the roll holder shaft 20, indeed may be summarized as follows. For clarity of disclosure, assume to subject roll 10 to a turning cycle and therefore that roll 10 is subjected to forces with axial component (parallel to axis X) due to the use of the lathe tool (not depicted in the drawings) on roll 10. As anticipated, in consideration of the axial forces involved during a turning cycle, roll 10 and the roll holder shaft 20 are or are not subjected to axial movements or possibly are subjected to negligible axial movements and in any case, such as not to compromise the turning operations. Contrarily, considering forces acting on roll 10 with greater axial component, such as those usually involved during the rolling, the roll is translated (for example, to the right with respect to the drawings), dragging in translation the roll holder shaft 20, where the translation of shaft 20 results in a translation of the inner ring of bearing 31 with respect to the outer ring (and similarly, of the inner ring of bearing 90 with respect to the outer ring), and also in the translation of assembly 60 consisting of the ball bearings 63 and 62 and of element 65, and therefore in the compression of the elastic means 51 and in the decompression (expansion) of the elastic means 52. Obviously, in the case of axial forces of the aforesaid type acting on roll 10 in opposite direction (from right to left with respect to the drawings), a movement from right to left of roll 10 and of shaft 20 takes place again, but here with compression of the elastic means 52 and decompression (expansion) of the elastic means 51.

With reference to FIGS. 6 to 10, a description is given below of a second embodiment of the present invention, where the component parts and/or features in FIGS. 6 to 10 already described above with reference to other drawings, are identified by the same reference numerals.

Figure 6:
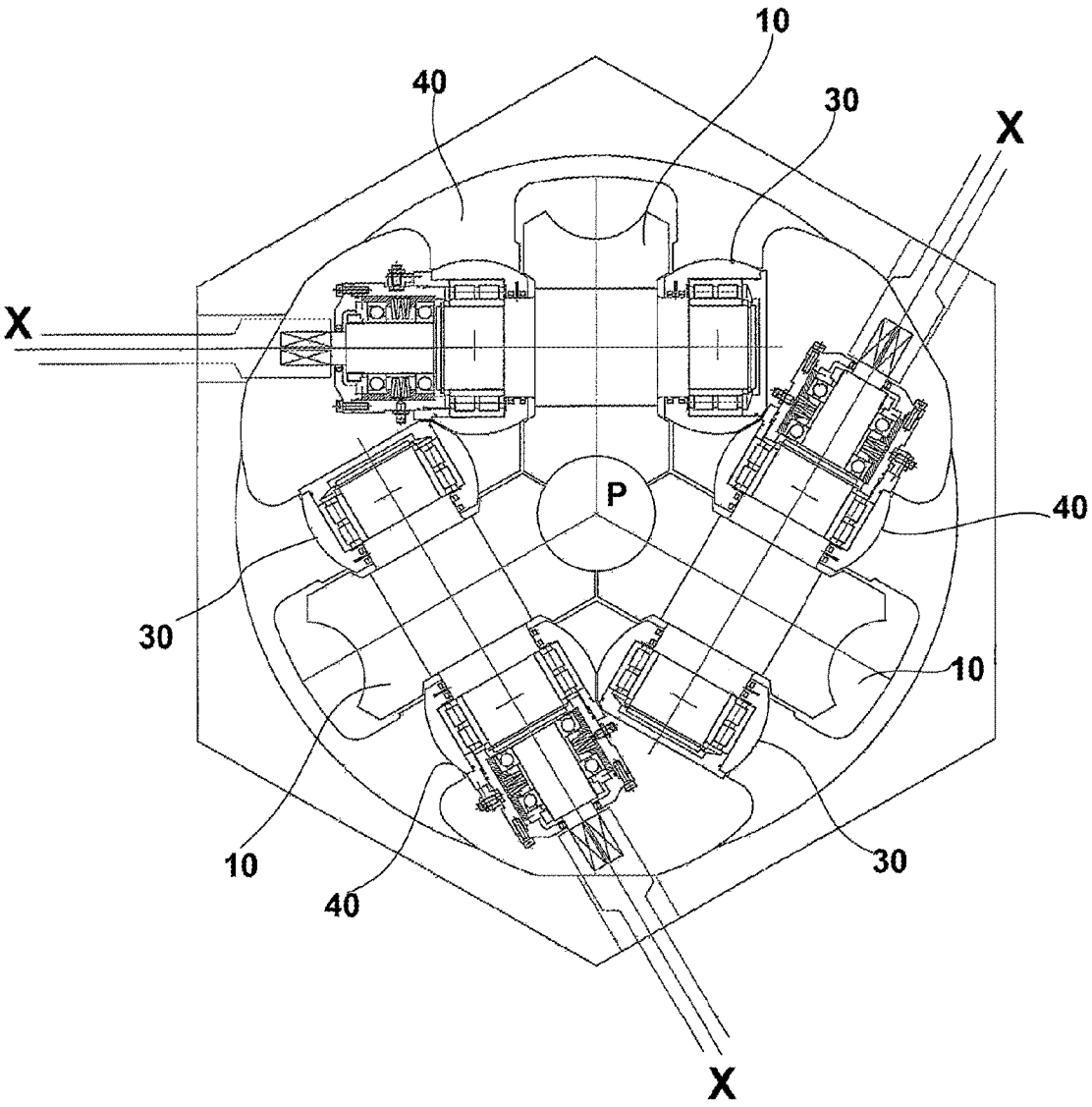
FIG. 6 shows a first cross-section view of a stand according to one embodiment of the present invention.

In stand 100 in FIG. 6, the rolls 10 are mutually essentially arranged, as in the stand in FIG. 1, to define a pass line P whereby a detailed description of stand 100 in FIG. 6 is omitted for reasons of brevity. Moreover, in the stand in FIG. 6, the elastic constraints by means of which the rolls 10 are constrained to stand 100 by means of the respective hollow supports 30 and 40 are different from the elastic constraints by means of which the rolls 10 are constrained to stand 100 in FIG. 1; the following description therefore relates to the aforesaid elastic constraints.

The most important difference between the elastic constraints depicted in FIGS. 7 to 10 and those depicted in FIGS. 2 to 5 relates to certain components housed in cartridge 41, and also to the mutual interaction thereof and the interaction thereof both with cartridge 41 and with the roll holder shaft 20.

Figure 3:
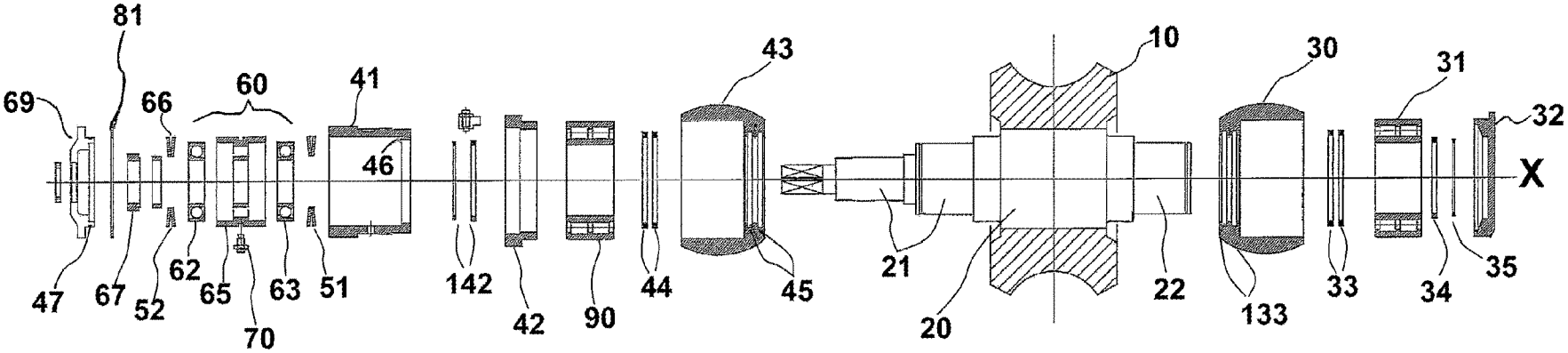
FIG. 3 shows a second longitudinal exploded sectional view of a roll assembly and related supporting systems according to one embodiment of the present invention.
Figure 7:
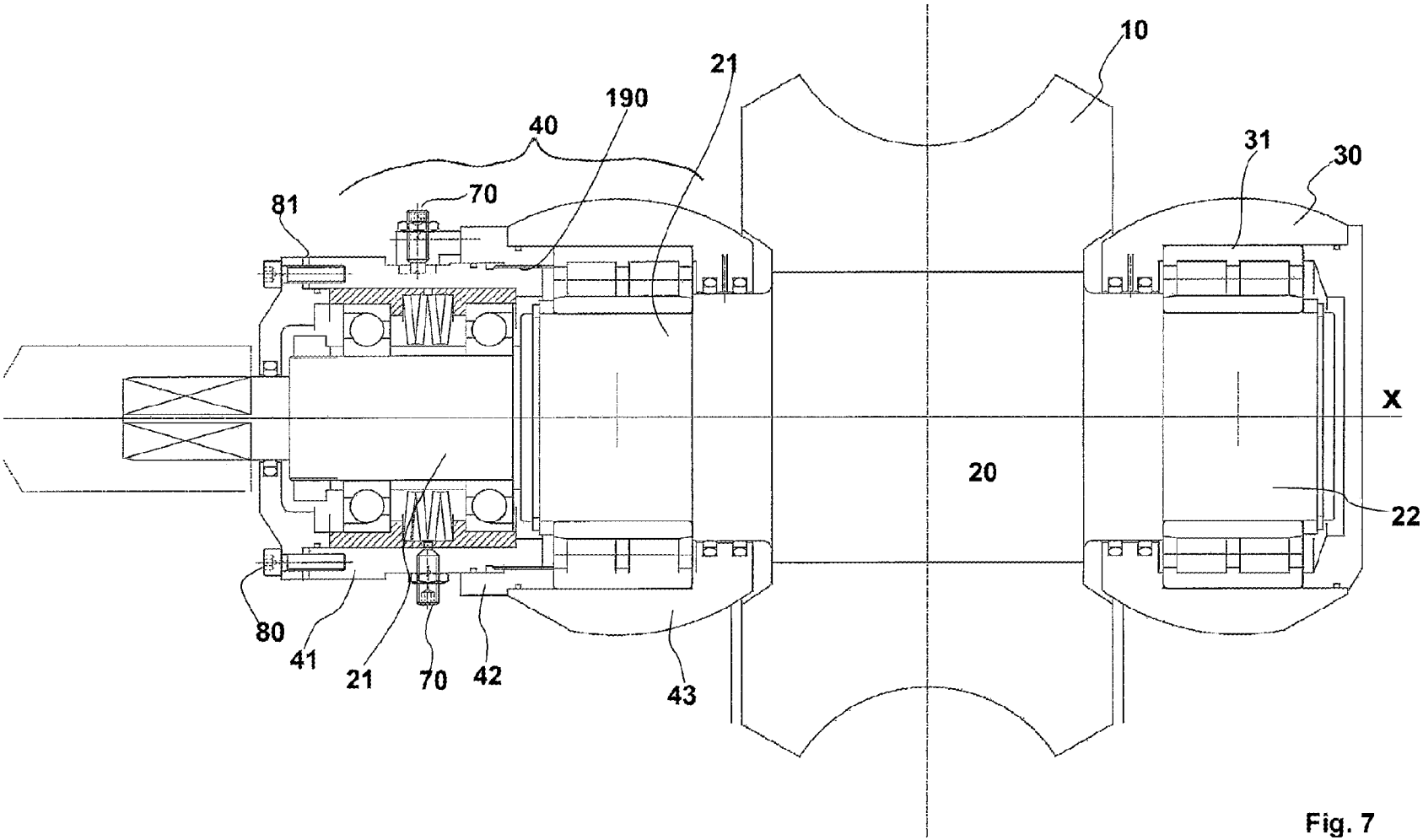
FIG. 7 shows a second longitudinal sectional view of a roll assembly and related supporting systems according to one embodiment of the present invention.
Figure 8:
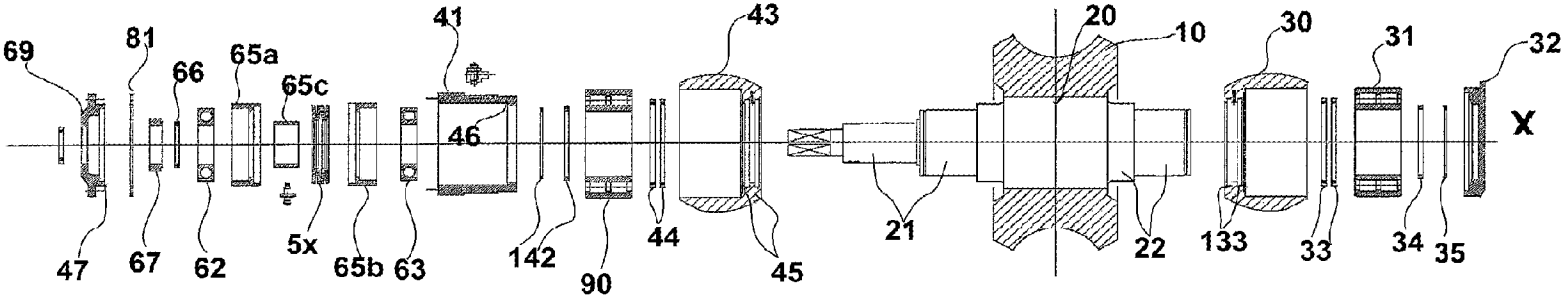
FIG. 8 shows a second longitudinal exploded sectional view of a roll assembly and related supporting systems according to one embodiment of the present invention.
Figure 9:
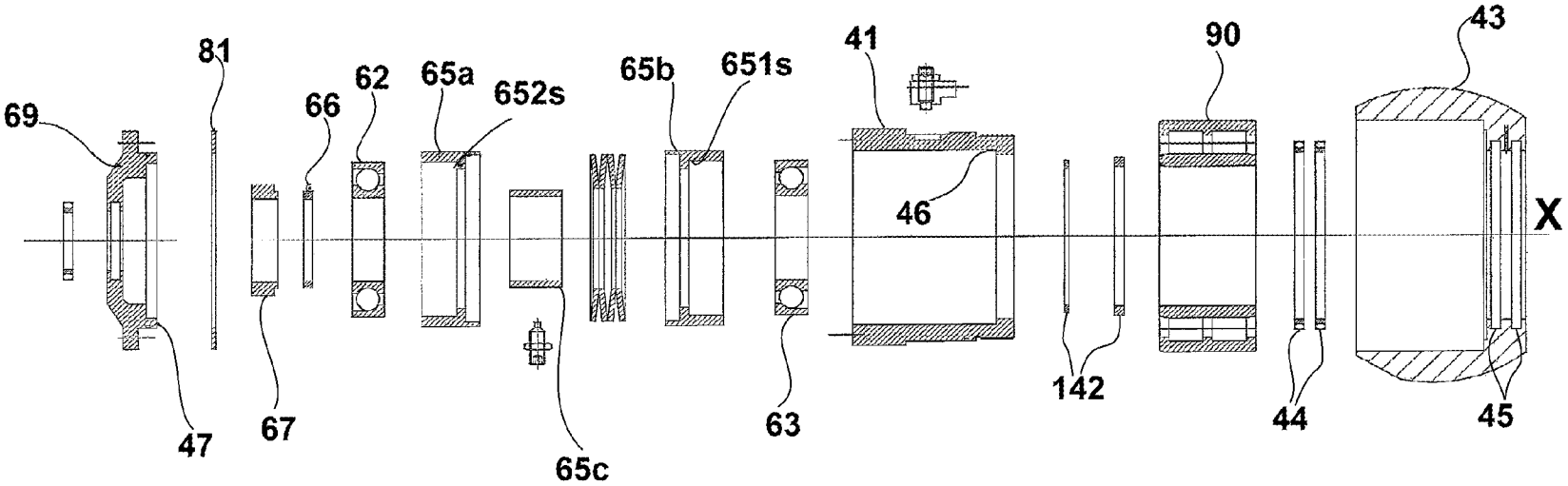
FIGS. 9 and 10 show further longitudinal exploded sectional views of a roll assembly and related supporting systems and/or parts thereof according to embodiments of the present invention.
Figure 10:
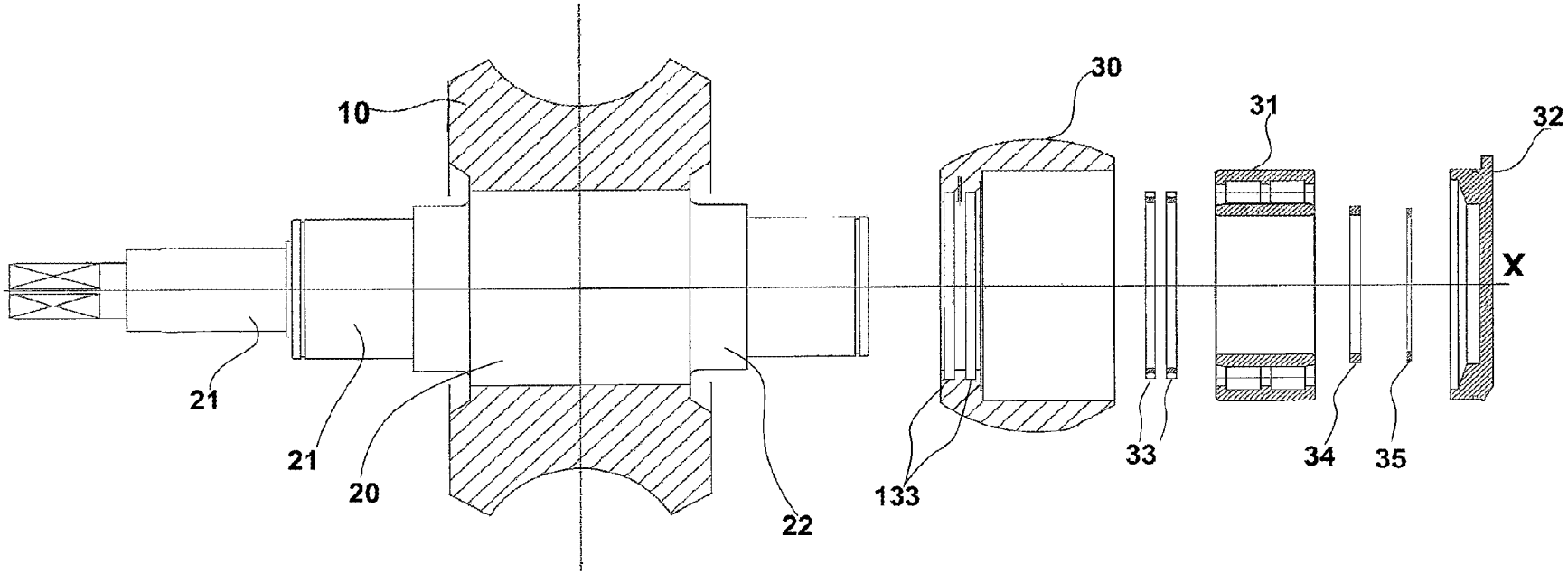

Indeed, it is in particular apparent from FIGS. 7 and 8 that in the case of the embodiment therein depicted, assembly 60 in FIG. 3, including the two ball bearings 62 and 63 and the corresponding housing 65, is replaced by an assembly again comprising a first ball bearing 63 and a second ball bearing 62, wherein the bearings 63 and 62 here are housed in a housing 65*b* and a housing 65*a*, respectively, the two housings 65*a* and 65*b* both being ring-shaped but in particular, separate from each other. Ball bearing 63 is housed in housing 65*b* axially resting against an inner shoulder 651*s* of housing 65*b*, and similarly ball bearing 62 is housed in housing 65*a*, in particular axially resting against an inner shoulder 652*s* of housing 65*a*.

A ring 65*c* is also mounted on portion 21 of the roll holder shaft 20, in particular in the housings 65*a* and 65*b*. In detail, the inner shoulders of the housings 65*a* and 65*b* mounted one adjacent to the other on the roll holder shaft 20 define an inner space delimited towards the roll holder shaft 20 of ring 65*c*, where space elastic means 5*x* are housed. According to the present invention, the aforesaid elastic means 5*x* may consist of the first elastic means 51 and second elastic means 52 described above, but they are arranged adjacent here, or alternatively they may consist of elastic means made in a single piece. Both the ball bearings 62 and 63 are rigidly fixed to the roll holder shaft 20 (to portion 21), while the housings 65*a* and 65*b* are susceptible to being translated with respect to cartridge 41. Moreover, the elastic means 5*x* are compressed between the two housings 65*a* and 65*b*, in particular being engaged by the inner shoulders of the aforesaid housings 65*a* and 65*b*.

It is therefore apparent in consideration of that disclosed above that the adjusting methods of the position of the roll holder shaft 20 (and therefore of roll 10 with respect to the hollow supports 30 and 40) in axial direction (parallel to axis X) substantially are similar to those for the positioning of the roll holder shaft 20 described above with reference to FIGS. 2 to 5. Indeed, also in this case by increasing the penetration of cartridge 41 in the ring nut 42 by mutual screwing of the corresponding threaded portions 190, the translation of cover 69 results in a translation (to the right with respect to the drawings) of the bearings 62 and 63, together with the housings 65*a* and 65*b* and ring 65*c*, and therefore in the repositioning (to the right with respect to the drawings) of shaft 20 and finally, of roll 10, where contrarily the repositioning of shaft 20 and of roll 10 to the left (with respect to the drawings) is obtained by decreasing the penetration of cartridge 41 in the ring nut 42.

Similarly, by decreasing the thickness of the couplings or spacers 81 inserted between cover 69 and cartridge 41, the compression (preload) of the elastic means 5*x* is increased as a consequence of the mutual approaching in axial direction of the two housings 65*a* and 65*b*.

The behavior of roll 10 according to the present embodiment, in particular of the roll holder shaft 20, may be summarized as follows. Again, for clarity of disclosure, assume that roll 10 is subjected to a turning cycle and therefore that roll 10 is involved by forces with axial component (parallel to axis X) due to the use of the lathe tool (not depicted in the drawings) on roll 10. Also in this case, since the axial forces involved during a turning cycle are less than the preload of the elastic means 5*x* (in any case adjustable according to the methods summarized above), roll 10 and the roll holder shaft 20 are not subjected to axial movements. Contrarily, considering forces acting on roll 10 with axial component greater than the preload of the elastic means 5*x* (such as those usually involved during the rolling), the roll is translated (for example, to the left with respect to the drawings), dragging in translation the roll holder shaft 20, where the translation of shaft 20 results in a translation to the left of bearing 63 and of housing 65*b* with subsequent approaching of housing 65*b* to housing 65*a* and further compression of the elastic means 5*x*. The same holds true in the case of movement to the right of shaft 20, where bearing 62 and housing 65*a* here are dragged to the right, with subsequent approaching of housing 65*a* to housing 65*b* and subsequent further compression of the elastic means 5*x*.

It has therefore been shown by the detailed description above of the embodiments of the present invention depicted in the drawings, that the present invention allows the desired results to be obtained and the drawbacks encountered in the prior art to be overcome or at least limited.

In particular, the elastic constraints according to the present invention allow both an axial movement (realignment of the rolls), for example during the rolling (when the axial components of the forces involved are decidedly greater than the resistance opposed by the elastic means), and the turning of the rolls directly on the stand (when the axial component of the forces resulting from the use of the lathe tool on the roll is less than the resistance exerted by the elastic means), and therefore without the need for the preventive disassembly of the rolls from the stand.

Moreover, the present invention provides a solution which can be achieved and/or installed at low costs and by means of operations with reduced and/or equally contained complexity.

Finally, the solution according to the present invention is applicable to different rolling mill stands, in particular for rolling both rod-shaped elements in general and tubes, in particular seamless tubes.

Although the present invention was clarified above by means of a detailed description of the embodiments thereof depicted in the drawings, the present invention is not limited to the embodiments described and depicted in the drawings; contrarily, all those variants and/or modifications of the embodiments described and depicted in the accompanying drawings, which are clear and apparent to those skilled in the art, fall within the scope of the present invention. For example, according to the present invention and according to the circumstances and/or needs, the roller bearings may be omitted or replaced by functionally equivalent bearings, and also the elastic means may be made with a multitude of materials and designs known to those skilled in the art.

Indeed, the present invention allows the broadest selection of components.

The scope of protection of the present invention is therefore defined by the claims.

The invention claimed is:

1. A rolling mill stand for rolling rod-shaped, tubular bodies, said stand comprising at least three rolls mutually arranged to define a rolling pass line (P) for said rod-shaped, tubular bodies, wherein at least one of said three rolls is integral on a roll holder shaft, which is in turn freely fixed in rotational manner to said stand by means of a first hollow support and a second hollow support arranged respectively on opposite sides of said at least one roll, wherein a first portion and a second portion of said roll holder shaft are housed in said first hollow support and in said second hollow support, respectively, said stand comprising elastic means interposed between said first portion of said roll holder shaft and said first hollow support to define an elastic type axial constraint between said roll holder shaft and said first hollow support, said stand comprising first supporting means rigidly keyed onto said first portion of said roll holder shaft and adapted to facilitate the rotation of said first roll holder shaft with respect to said first hollow support, said elastic means comprising first elastic means and second elastic means arranged along said first portion of said roll holder shaft on opposite sides of said first supporting means, respectively.

2. The stand according to claim 1, wherein the translation of said roll holder shaft along a translation direction parallel to its symmetry axis (X) transforms into the compression of at least part of said elastic means and is thus contrasted by the resistance exerted by at least said part of said elastic means.

3. The stand according to claim 1, wherein the translation of said roll holder shaft along a translation direction parallel to its symmetry axis (X) also translates into the expansion of at least part of said elastic means.

4. The stand according to claim 1, wherein said elastic means are conical and mounted on said first portion of said roll holder shaft.

5. The stand according to claim 1, wherein said first supporting means define a first engagement shoulder and a second engagement shoulder, said first hollow support defines a third engagement shoulder and a fourth engagement shoulder, and said first elastic means engage said first engagement shoulder and said third engagement shoulder, while said second elastic means engage said second engagement shoulder and said fourth engagement shoulder.

6. The stand according to claim 1, wherein said first supporting means comprise a first ball bearing and a second ball bearing.

7. The stand according to claim 1, stand comprising means for adjusting the preload of the elastic means.

8. The stand according to claim 1, said stand comprising means for adjusting the position of the roll in the direction of its longitudinal symmetry axis (X).

9. A rolling mill for rolling seamless tubes, said rolling mill comprising at least two rolling stands arranged in succession along a predetermined direction, said rolling mill comprising at least one rolling stand according to claim 1.

10. A rolling mill stand for rolling rod-shaped, tubular bodies, said stand comprising at least three rolls mutually arranged to define a rolling pass line (P) for said rod-shaped, tubular bodies, wherein at least one of said three rolls is integral on a roll holder shaft, which is in turn freely fixed in rotational manner to said stand by means of a first hollow support and a second hollow support arranged respectively on opposite sides of said at least one roll, wherein a first portion and a second portion of said roll holder shaft are housed in said first hollow support and in said second hollow support, respectively, said stand comprising elastic means interposed between said first portion of said roll holder shaft and said first hollow support to define an elastic type axial constraint between said roll holder shaft and said first hollow support, said stand comprising first supporting means rigidly keyed onto said first portion of said roll holder shaft and adapted to facilitate the rotation of said first roll holder shaft with respect to said first hollow support, said elastic means being arranged along said first portion of said roll holder shaft in an inner space defined by said first supporting means.

11. The stand according to claim 10, wherein said first supporting means define a first engagement shoulder and a second engagement shoulder, and said elastic means engage said first engagement shoulder and said second engagement shoulder.

12. A rolling mill stand for rolling rod-shaped, tubular bodies, said stand comprising at least three rolls mutually arranged to define a rolling pass line (P) for said rod-shaped, tubular bodies, wherein at least one of said three rolls is integral on a roll holder shaft, which is in turn freely fixed in rotational manner to said stand by means of a first hollow support and a second hollow support arranged respectively on opposite sides of said at least one roll, wherein a first portion and a second portion of said roll holder shaft are housed in said first hollow support and in said second hollow support, respectively, said stand comprising elastic means interposed between said first portion of said roll holder shaft and said first hollow support to define an elastic type axial constraint between said roll holder shaft and said first hollow support, said stand comprising switching locking means which can be alternatively activated and deactivated, the activation of said locking means translating into the switching of the axial constraint between said roll holder shaft and said first hollow support from elastic to rigid.

* * * * *